US005254905A

United States Patent [19]

Dunbar et al.

[11] Patent Number: 5,254,905

[45] Date of Patent: Oct. 19, 1993

[54] CATHODE-LUMINESCENT PANEL LAMP, AND METHOD

[75] Inventors: Thomas A. Dunbar, Horseheads; Richard F. Kankus, Elmira; Thomas J. Kolonoski, Horseheads, all of N.Y.

[73] Assignee: Imaging & Sensing Technology Corporation, Horseheads, N.Y.

[21] Appl. No.: 778,194

[22] PCT Filed: May 10, 1990

[86] PCT No.: PCT/US90/02644

§ 371 Date: Jan. 3, 1992

§ 102(e) Date: Jan. 3, 1992

[87] PCT Pub. No.: WO91/17563

PCT Pub. Date: Nov. 14, 1991

[51] Int. Cl.[5] ..... H01J 63/02

[52] U.S. Cl. ..... 313/495; 313/399; 313/400; 313/479

[58] Field of Search ..... 313/495, 399, 400, 401, 313/479; 358/237, 236, 60

[56] References Cited

U.S. PATENT DOCUMENTS

| | | | |
|---|---|---|---|
| 4,193,014 | 3/1980 | Nixon | 313/495 |
| 4,352,043 | 9/1982 | Rigden | 313/495 |
| 4,737,683 | 4/1988 | Shichao et al. | 313/495 |
| 4,792,718 | 12/1988 | Knapp | 313/399 |
| 4,857,800 | 8/1989 | Ohkoshi et al. | 313/495 |
| 4,893,056 | 1/1990 | Hara et al. | 313/495 |
| 5,089,883 | 2/1992 | Welker et al. | 358/60 |

FOREIGN PATENT DOCUMENTS

| | | | |
|---|---|---|---|
| 2089561 | 6/1982 | United Kingdom | 313/495 |
| 2097181 | 10/1982 | United Kingdom | 313/495 |

OTHER PUBLICATIONS

Mercer et al.; "Fluorescent Backlights for LCD's"; SPIE; vol. 1117; Display System Optics III; pp. 168-176; Nov. 1989.

*Primary Examiner*—Donald J. Yusko
*Assistant Examiner*—N. D. Patel
*Attorney, Agent, or Firm*—Sommer, Oliverio & Sommer

[57] ABSTRACT

A cathode-luminescent panel lamp (20) includes an evacuated tube (21) having a phosphor coating (25) on the inside surface of a face plate (24). An electron gun (28) is arranged to discharge at least one conical beam of electrons toward the coating to form an electron cloud within the tube. Shaping electrodes (29,30) positioned within the tube distribute and normalize the electron density of the cloud as a function of the angle ($\theta$). The electrons pass through a field-separating mesh (39) to impinge upon a secondary emission mesh (40), which amplifies the electron density. The amplified electrons excite the phosphor coating to produce light of substantially-constant intensities across the face plate. The improved lamp may be used to back-light an LCD or in a stadium display.

19 Claims, 4 Drawing Sheets

Fig. 6.
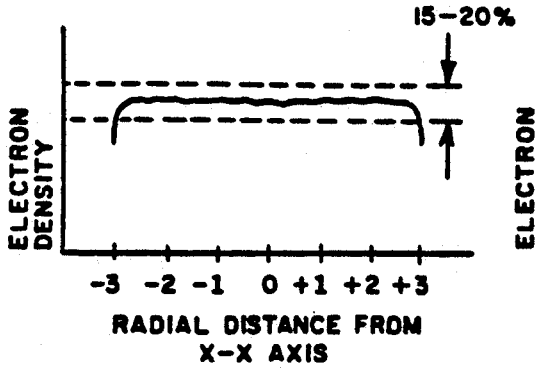
Fig. 9.
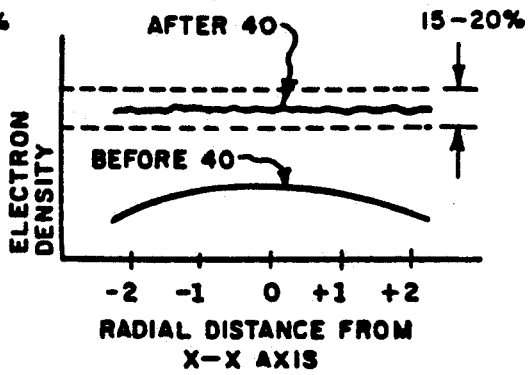
Fig. 7.
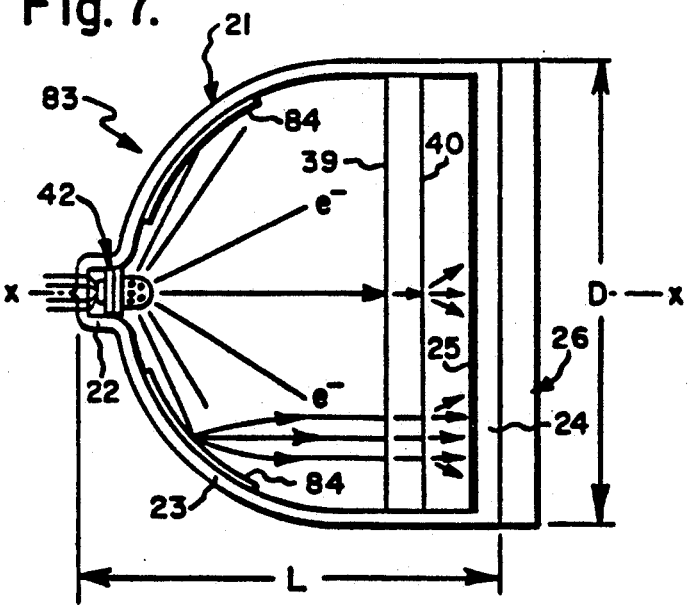
Fig. 8.
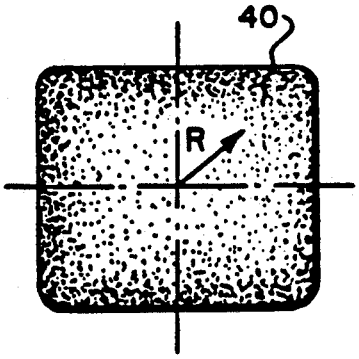
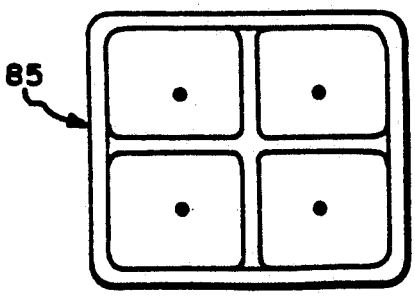
Fig. 10.
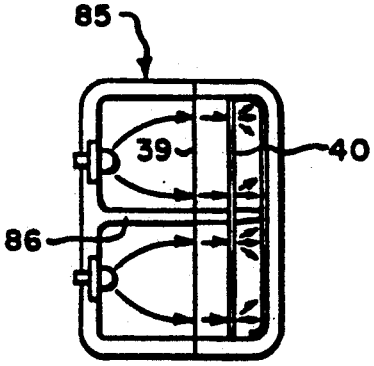
Fig. 11.

CATHODE-LUMINESCENT PANEL LAMP, AND METHOD

Field of the Invention

The present invention relates generally to the field of luminescent panels and lamps, and, more particularly, to an improved evacuated tube in which a cloud of electrons issuing from a cathode are first distributed and normalized to shape the cloud, and are then directed, with magnification of the electron density, against a phosphor coating on the inside surface of a face plate to produce a uniform illumination of the entire area of the face plate.

BACKGROUND ART

In recent years, there has been an increasing tendency to use liquid crystal displays (LCD's), dot matrix displays, and other flat displays in modern avionics. Such devices typically offer the advantages of long life, lower power consumption, high resolution and definition, and multi-colored displays.

At the same time, it is necessary to back-light the display in order that its indicia and information may be seen against a contrasting background. To date, several back-lighting techniques have been developed. These techniques include the use of fluorescent illumination, electro-luminescent panels, incandescent lighting and ganged light-emitting diodes (LED's). Each of these prior art techniques is believed to have individual disadvantages and shortcomings.

For example, fluorescent lamps must be operated continuously in order to back-light the display. This causes considerable heat to be generated. Fluorescent lamps are also temperature-dependent, particularly during start-up conditions. The light output of such lamps may vary by a factor of about 100 within an operating range of from about −20° C. to about +40° C. During cold start-up conditions, considerable heat is required to initially vaporize the mercury, and to break down the vapor into a self-maintaining discharge. This discharge, which is rich in ultraviolet radiation, excites a visible radiation from a phosphor or fluorescent coating on the inside of the tube. The particular wavelength of light generated by mercury vapor (i.e., $\lambda_{Hg}=254$ nanometers) is believed to destabilize the silicon transistor matrix in the LCD. Another problem is that fluorescent lamps are usually formed as elongated tubes. Hence, it is necessary to diffuse the light from such tubes to uniformly illuminate a large area behind the LCD display. While the efficiency of the phosphor used in fluorescent lamps is typically on the order of about 80 lumens per watt, such tubes normally have a maximum output of about 6,000 foot-Lamberts (ft-L). In passing through the diffuser and the LCD display itself, however, the intensity of light available for usable display contrast may be dramatically reduced to about 200 (ft-L). While this level may be acceptable under normal room conditions, under conditions of brilliant sunshine, such as in the cockpit of an aircraft, the ambient light intensity may be on the order of about 10,000 ft-L, thereby making the display difficult to read. In effect, a high level of ambient light may literally "wash out" the normal contrast between the displayed information and the background illumination. Additional details of such fluorescent back-lighting techniques may be found in Mercer and Schoke, "Fluorescent Backlights for LCDs", *Information Display* at pp. 8–13 (Nov. 1989), and Kishimoto and Terada, "Flat Fluorescent Lamp for LCD Back-Lighting", SPIE, Vol. 1117, *Display Systems Optics II* at pp. 168–176 (1989).

It is also known to use electro-luminescent panels to back-light an LCD display. With such panels, the problem of non-uniformity is minimal. However, two other problems become evident. Such panels are considerably less bright than fluorescent tubes. Luminances on the order of about 30 ft-L are commonly reported. Secondly, these panels are also temperature-dependent, and it is necessary to heat the panel in order to maintain even limited brightness. As much as 17 watts per square inch [2.635 watts/cm$^2$] of power may be required during cold starts. Moreover, the amount of light generated decreases over time. With some panels, light output is expected to decrease by about fifty percent after about 1500 hours of use. Additional details of such electro-luminescent panels may be found in U.S. Pat. No. 4,767,965 ("Flat Luminescent Lamp for Liquid Crystalline Display"), and U.S. Pat. No. 4,143,404 ("Laminated Filter-Electro-luminescent Rectifier Index for Cathode Ray Display").

Incandescent lamps have also been used to back-light an LCD display. However, non-uniformity of illumination is a common problem. Moreover, these lamps are relatively inefficient, as compared with fluorescent tubes, and usable life is somewhat limited. As a result, incandescent lamps are not believed to be in common use for back-lighting LCD's.

Finally, ganged LED's have also been used as back-light sources. Here again, uniformity of illumination is a persistent problem, typically requiring the use of a diffuser. Moreover, power consumption is typically greater than with fluorescent tubes and electro-luminescent panels.

Accordingly, there is believed to be a need for an improved means for back-lighting an LCD or dot matrix display, which affords the advantage of high-contrast with the LCD under extreme conditions of ambient lighting, which has a controllable brightness, which is reliable, which affords uniform illumination of the display, which has a long service life, and which does not require heating.

DISCLOSURE OF THE INVENTION

With parenthetical reference to the first disclosed embodiment for the purpose of illustration, this invention provides, in one aspect, an improved cathode-luminescent panel lamp (e.g., 20) which broadly includes: an evacuated tube (e.g., 21) having a face plate (e.g., 24) and having a phosphor coating (e.g., 25) provided on the inside surface of the face plate, the phosphor coating functioning as an anode and being operatively arranged to convert electrons impinging thereon into light passing through the face plate; an electron gun (e.g., 28) arranged within the tube in spaced relation to the phosphor coating, the gun being operatively arranged to selectively emit at least one beam of electrons toward the coating to form an electron cloud within the tube; and shaping means (e.g., 29,30) operatively arranged within the tube between the gun and coating for causing the intensity of light emitted by the coating through the face plate to be substantially uniform across the area of the coating.

The shaping means may be in the form of shaping electrodes (e.g., 29,30) provided within the tube and provided with a suitable voltage, to distribute and normalize the density of the electron cloud with respect to the phosphor coating so that the density of the electron cloud impinging upon the phosphor coating will be substantially constant; a secondary emission coating (e.g., 84) provided on the inside surface of the tube for generating a secondary emission of electrons (again with the object of distributing and normalizing the electron cloud with respect to the phosphor coating); and a variable-efficiency or variable-density emission coating provided on the secondary mesh positioned between the electron gun and the phosphor coating (again with the object of distributing and normalizing the electron cloud with respect to the phosphor coating), or in some other form.

In another aspect, the invention provides an improved method of creating a substantially-uniform illumination of an area, with accompanying control over the brightness of such area, which method comprises the steps of: providing an evacuated tube (e.g., 21) having a face plate (e.g., 24) through which light is to pass; providing a phosphor coating (e.g., 25) on the inside surface of the face plate; providing an electron gun (e.g., 28) within said tube in spaced relation to the coating; causing the gun to emit at least one beam of electrons toward the coating to form an electron cloud within the tube; and shaping the electron cloud such that an electron cloud of substantially-uniform density as a function of the angle (i.e., $\theta$) or radial distance from the center of the face plate, will impinge on the entire area of the phosphor coating; thereby to excite the phosphor coating to emit light through the face plate of substantially-uniform intensity over its entire area.

Accordingly, the general object of the invention is to provide an improved cathode-luminescent panel lamp, which is particularly useful for, but not limited to, back-lighting an LCD display.

Another object is to provide an improved panel lamp which requires no additional reflectors of diffusers in order to obtain substantially-uniform light intensity over the illuminated area.

Another object is to provide an improved panel lamp, which is particularly useful in back-lighting an LCD display and in which the intensity of the light generated is uniform and may be varied.

Another object is to provide an improved means for back-lighting an LCD which does not produce light in the ultraviolet range, which might otherwise adversely affect various parts and components of the LCD.

Another object is to provide an improved means using an electron gun to produce a cloud of electrons which is used to produce light of substantially-constant intensity over the entire illuminated area for uniformly back-lighting an LCD display.

Another object is to provide an improved means for back-lighting an LCD which offers the advantage of reduced power consumption, increased reliability, controllable and selectively increased brightness, the capability of displaying various graphic images in addition to alpha-numerics, which offers increased efficiency, and in which the intensity of back-lighting is selectively adjustable to adjust for changes in ambient lighting conditions.

Still another object is to provide an improved panel lamp which is particularly suited for use in a matrix or rectangular array, such as in a stadium scoreboard or display.

These and other objects and advantages will become apparent from the foregoing and ongoing written specification, the drawings, and the appended claims.

BRIEF DESCRIPTION OF THE DRAWINGS

FIG. 6 is an illustrative plot of electron density (ordinate) vs. radial distance from x—x axis (abscissa), showing that the density of the electron cloud approaching the secondary emission mesh is substantially constant and falls within a particular bandwidth.

FIG. 7 is a schematic fragmentary vertical sectional view of a third form of the improved lamp, showing the elemental electron gun as being arranged to discharge conical beams of electrons at various angles with respect to the cathode to form an electron cloud, and further showing some of the electrons having the greatest angle $\theta$ as impinging upon a secondary emission coating on the inside surface of the tube intermediate funnel portion.

FIG. 8 is a front elevation of the secondary emission mesh shown in FIG. 7, this view graphically depicting the that the density of the secondary emission coating thereon increases as a function of the radius R from centerline axis x—x.

FIG. 9 is a plot showing radial distance R from axis x—x (ordinate) vs. electron cloud density (abscissa) of the embodiment shown in FIGS. 7 and 8 both immediately before and immediately after the secondary emission grid.

FIG. 10 is a schematic front elevation of a fourth form of the improved lamp, showing four individual lamps as being arranged in a rectangular array or matrix.

FIG. 11 is a fragmentary schematic vertical sectional view of the fourth form shown in FIG. 10, showing the adjacent lamps as sharing common intermediate wall portions, with the field-separating and secondary emission grids spanning all four lamps.

MODE(S) OF CARRYING OUT THE INVENTION

Figure 1:
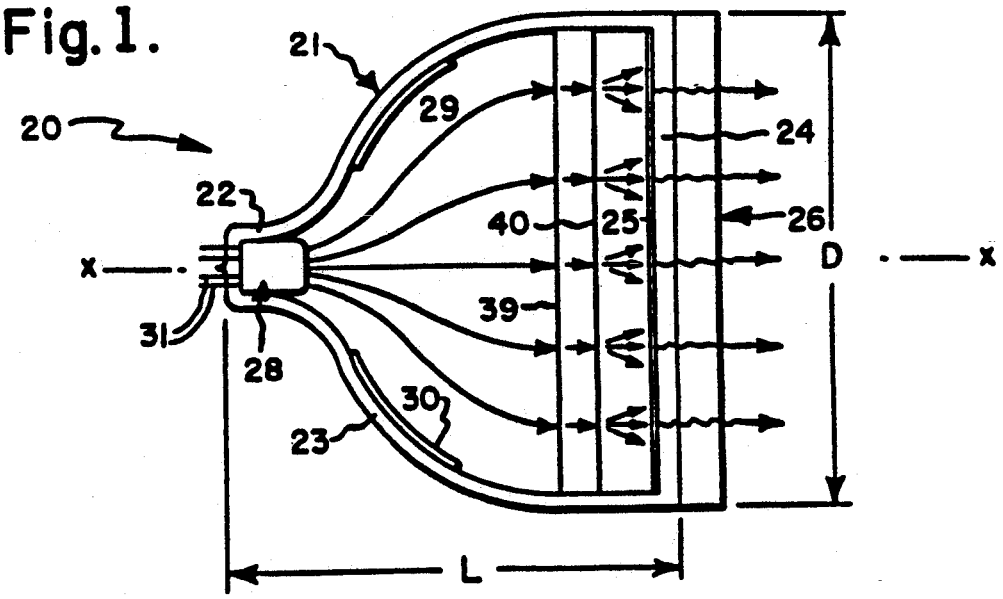
FIG. 1 is a schematic fragmentary vertical sectional view of a first form of the improved lamp, showing the space charge effect electron gun, the field-separating mesh, the secondary emission mesh, the phosphor coating on the inside surface of the face plate, and further showing an LCD arranged immediately in front of the face plate to be back-lighted by the improved lamp.

At the outset, it should be clearly understood that like reference numerals are intended to identify the same structural elements, portions or surfaces consistently throughout the several drawing figures, as such elements, portions or surfaces may be further described or explained by the entire written specification of which this detailed description is an integral part. Unless otherwise indicated, the drawings are intended to be read (e.g., arrangement of parts, mounting, etc.) together with the specification, and are to be considered a portion of the entire written description of this invention. As used in the following description, the terms "horizontal", "vertical", "left", "right", "up" and "down", as well as adjectival and adverbial derivatives thereof (e.g., "horizontally", "right-wardly", "upwardly", etc.) simply refer to the orientation of the illustrated structure as the particular drawing figure faces the reader. Unless otherwise indicated, the terms "inwardly" and "outwardly" refer to the orientation of a surface relative to its axis of elongation, or axis or rotation, as appropriate.

Figure 2:
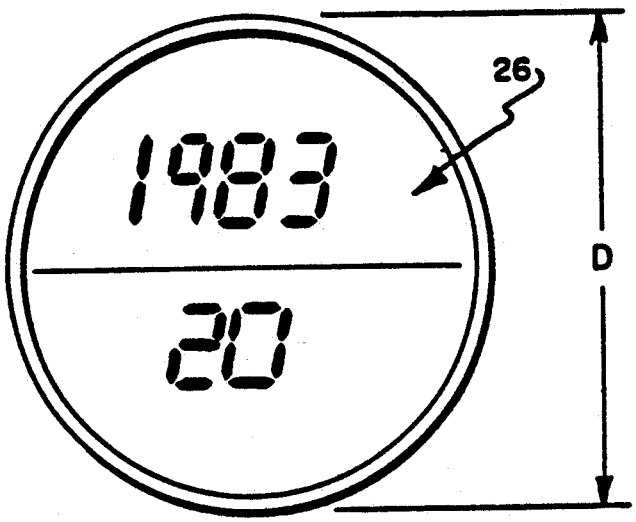
FIG. 2 is a front elevation of the LCD shown in FIG. 1, illustrating exemplary information on the LCD as being back-lighted by the improved lamp.
Figure 3:
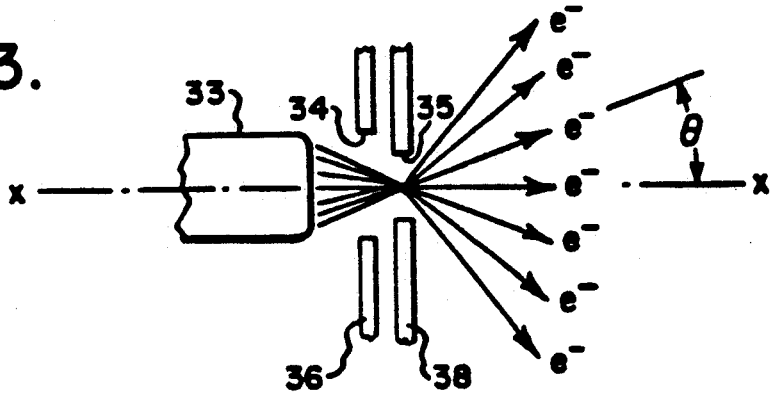
FIG. 3 is an enlarged schematic fragmentary vertical sectional view of the space charge effect electron gun shown in FIG. 1.

Turning now to the drawings, the present invention provides an improved cathode-luminescent lamp which is particularly adapted for use in back-lighting LCD's, dot matrix displays, and the like. However, the invention is deemed to have utility apart from this particular back-lighting use, as described infra. Hence, the invention should not be limited to this particular environment or use, unless an explicit limitation to that effect appears in the appended claims. Several forms of the improved lamp are disclosed herein. A first form is shown in FIGS. 1-3, a second in FIGS. 4-6, a third in FIGS. 7-9, and a fourth in FIGS. 10-11. These four forms, as well as various modifications thereof, will be discussed seriatim herebelow.

First Form (FIGS. 1-3)

Referring now to FIGS. 1-3, a first form of the improved lamp, generally indicated at 20 in FIG. 1, is shown as including an evacuated tube 21 having a leftward neck portion 22, an intermediate rightwardly-divergent funnel portion 23, and a rightward planar vertical face plate 24 provided with a suitable phosphor coating 25 on its inside surface. Tube 21 is shown as being elongated along horizontal axis x—x and has an axial length L and a face plate diameter (or diagonal) D. An LCD, generally indicated at 26, is positioned immediately to the right of the face place such that light produced by lamp 20 is arranged to back-light information, shown to be numbers "1983" and "20" for purposes of illustration, displayed on the LCD (FIG. 2).

Lamp 20 includes a space charge effect electron gun, generally indicated at 28. A plurality of shaping electrodes, two of which are indicated at 29 and 30, are arranged on the inside surface of funnel portion 23. Suitable voltages are provided to electrodes 29,30 via appropriate lamp input terminals, severally indicated at 31, to cause a beam of electrons to issue from the planar circular vertical emitting surface 32 of a thermionic cathode 33 within the gun (FIG. 3). After leaving the emitting surface, these electrons sequentially pass through aligned apertures 34,35 of a pair of axially-spaced grids 36,38 respectively. Grids 36,38 are provided with suitable voltages via appropriate circuit input terminals 31. The electrons (i.e., e) issuing from emitting surface 32 are caused to first converge as they pass through the first grid opening 34, and then crossover as they pass through the second grid opening 35 to form a rightwardly-divergent conical beam. Each divergent electron path has an angle $\theta$ with respect to axis x—x. Suitable voltages are provided to shaping grids 29,30 via appropriate circuit input terminals 31. The effect of these shaping voltages is to "bend" or normalize the paths of the various non-axial electrons, as a function of their respective angles $\theta$, such that substantially all of the electrons will thereafter travel along paths substantially parallel to tube axis x—x, as schematically indicated in FIG. 1. Moreover, after being so shaped and directed, the density of the electrons will be substantially constant in a plane transverse to axis x—x.

A circular vertical field-separating mesh 39 and a circular vertical secondary emission mesh 40 are operatively arranged in the path of the normalized and distributed electron cloud. The field-separating mesh separates the relatively low-strength electrical field produced by shaping electrodes 29,30 from the relatively high strength field produced by coated anode 25, which is provided with a suitable voltage via appropriate circuit input terminals 31 or other connection through tube 21. Secondary mesh 40 is provided with a suitable coating, and produces a magnified number of electrons for every incident electron passing through mesh 39. In effect, secondary mesh 40 increases the gain of the electron density in the cloud, while preserving the substantially uniform distribution of same across the projected circular area of the phosphor coating. The electrons emitted from secondary mesh 40 impinge upon phosphor coating 25, thereby exciting it to emit light of substantially-uniform intensity through face plate 24 to back-light the indicia displayed on LCD 26.

In this first form, the shaping electrodes cause the divergent electrons emitted from gun 28 to be distributed substantially uniformly as they approach field-separating mesh 39. The secondary emission mesh 40, which is also supplied with power via an appropriate circuit input terminal 31 or other connection through tube 21, merely amplifies the number of electrons directed normally (i.e., perpendicularly) at the phosphor coating, while maintaining the substantially-uniform density of the electron distribution across the projected area of the phosphor coating. In other words, in this first form, the density of electrons striking the phosphor coating is not the same as the density of the electrons passing through the field-separating mesh. However, both densities are substantially proportional, and are uniformly distributed across the entire projected area of the phosphor coating. Hence, the light generated by the phosphor coating and passing through the face plate will be of substantially-constant intensity across the area of the face plate to uniformly back-light the LCD.

The foregoing arrangement is not invariable. In the just-described form, the divergent stream of electrons emitted by the space effect gun is first shaped and distributed to produce an electron cloud of substantially-constant electron density across the projected area of the phosphor coating in a plane perpendicular to axis x—x. Alternatively, the electron beam need not be so shaped. For example, if the electrons issue from the cathode emitting surface as a substantially-conical beam of variable radial density, phosphor coating 25 could be formed to have a variable efficiency inversely related to the incident electron density. Thus, if the electron density varies inversely to angle $\theta$, the efficiency of the phosphor coating may be reciprocally complimentary, such that the coating efficiency will be greatest where the electron density is least and thinnest where the electron is density is greatest, all with the object of causing the cloud striking the phosphor coating for producing substantially-uniform illumination of the face plate across its entire area. Similarly, while the face plate is shown as being circular in the illustrated form, this need not invariably obtain. Alternatively, the face plate could have some other arcuate or polygonal shape, as desired.

In yet another variation, the inside surface of the funnel portion 23 could be coated with a suitable secondary emission coating, as described infra, such that electrons issuing from gun 28 at a large angle will strike the secondary emission coating and induce an amplified electron discharge therefrom toward coating 25.

Figure 4:
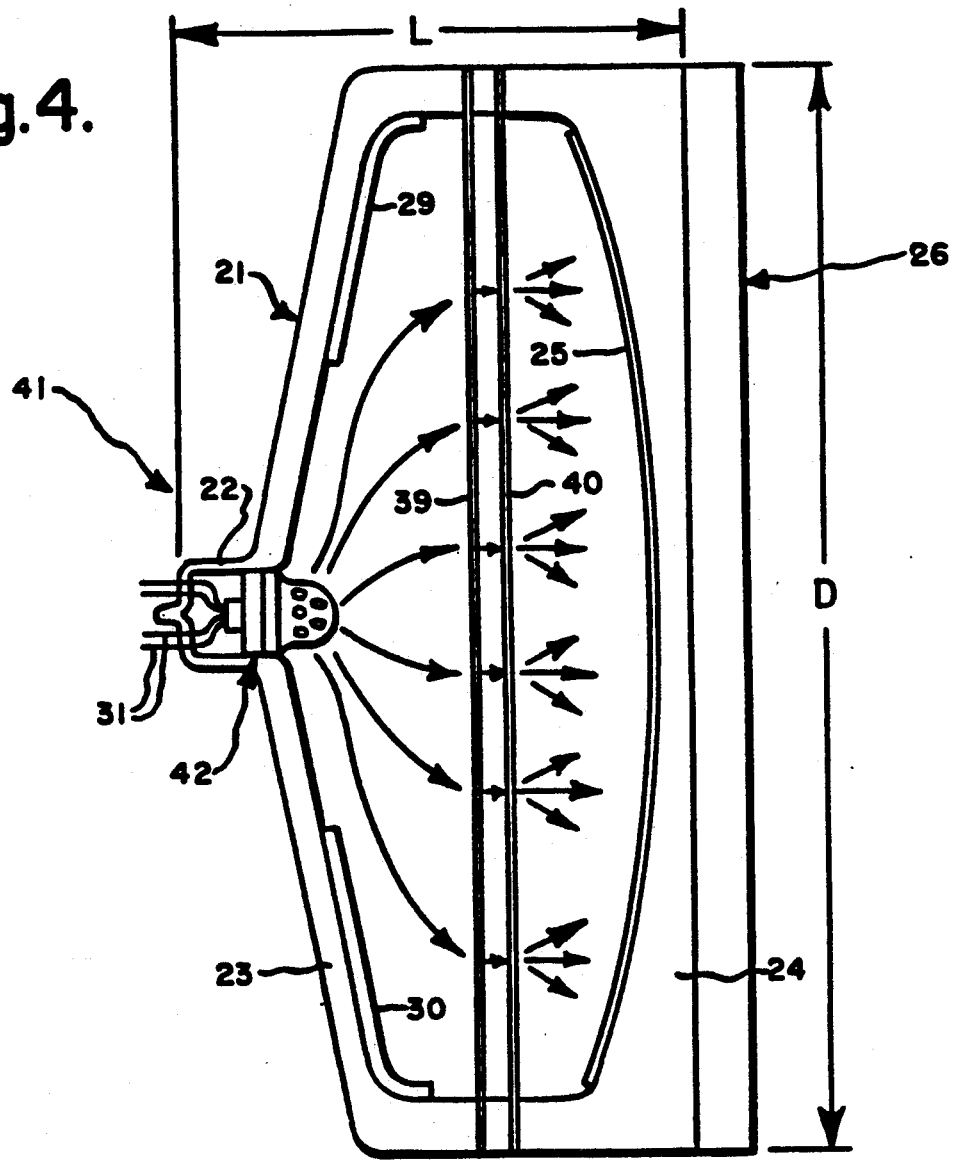
FIG. 4 is a schematic fragmentary vertical sectional view of a second form of the improved lamp, showing an elemental electron gun, the field-separating and secondary meshes, the phosphor coating on the inside surface of the face plate, and the LCD display arranged immediately in front of the face plate.
Figure 5:
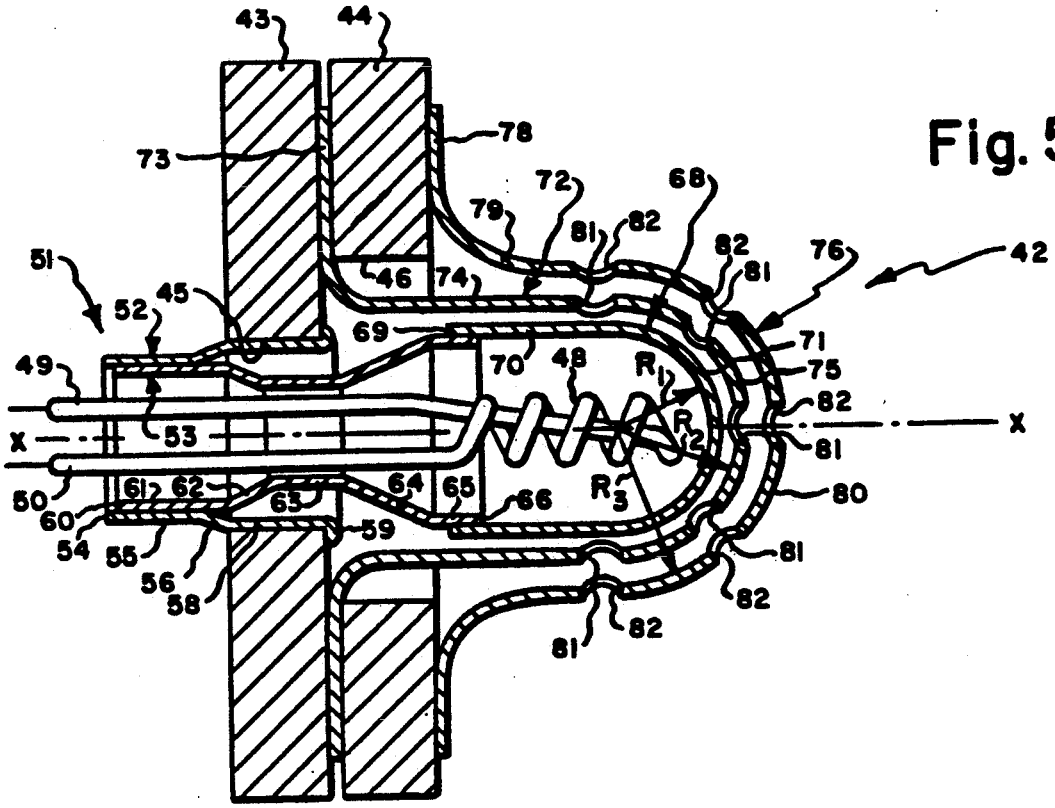
FIG. 5 is a schematic fragmentary vertical sectional view of the elemental electron gun shown in FIG. 4.

Second Form (FIGS. 4–6)

A second form of the improved lamp is generally indicated at 41 in FIGS. 4–6. This second form is shown as again including an evacuated tube 21, albeit of slightly different shape, having a leftward narrowed neck portion 22, an intermediate funnel portion 23, and a rightward face plate 24. This tube has a larger diameter-to-length ratio (i.e., D/L) than in the first form. An LCD 26 is positioned immediately in front of the face plate (i.e., to the immediate right of the face plate in FIG. 4) so that information displayed on the LCD will be back-lighted by the light passing through the face plate. A phosphor coating 25 is again provided within the tube on the surface of the face plate.

In this form, however, the space effect electron gun is replaced by an elemental electron gun, generally indicated at 42. As best shown in FIG. 5, gun 42 is mounted on two horizontally-spaced rectangular vertical dielectric blocks 43,44, respectively. Left block 43 is provided with a central through-hole 45 of relatively-small diameter, and right block 44 is provided with an aligned coaxial through-hole 46 of somewhat enlarged diameter. A heater 48, connected to appropriate circuit input terminals 31 via leads 49,50, penetrates openings 45,46 so as to be operatively arranged to heat the cathode's emitting surface.

A two-piece cathode support clip 51 includes an outer part 52 and an inner part 53. The outer part is shown as being a thin-walled tubular member generated about axis x—x, and sequentially includes: an annular vertical left end face 54, a horizontal cylindrical portion 55 extending rightwardly therefrom, a rightwardly- and outwardly-divergent frusto-conical portion 56, a horizontal cylindrical portion 58 continuing right-wardly therefrom to be frictionally arranged within left block opening 45, and an annular stop portion 59 arranged to abut a marginal portion of the right face of block 43 immediately about opening 45. The inner part 53 is also shown as being a thin-walled tubular member generated about axis x—x, and sequentially includes: an annular vertical left end face 60, a horizontal portion cylindrical portion 61 extending rightwardly therefrom within outer part cylindrical portion 55 and engaging portion 55, a rightwardly- and inwardly-inclined frusto-conical portion 62, a horizontal cylindrical portion 63, a rightwardly-and outwardly-inclined frusto-conical portion 64, and a horizontal cylindrical portion 65 continuing rightwardly therefrom and terminating in an annular vertical end face 66. The cathode is shown as further including a cup-shaped member 68 mounted on inner member 53. Member 68 has an annular vertical left end face 69, a horizontal cylindrical wall portion 70 extending rightwardly therefrom in frictionally-engaged overlapped relation with respect to the right marginal end portion of inner part surface 65, and an integrally-formed rightwardly-convex hemi-spherical emitting surface 71.

A control grid 72 surrounds the cathode. Grid 72 is shown as being a deeply-drawn cup-shaped member provided with an annular vertical flange 73 about its leftward open mouth. Flange 73 is held between the facing surfaces of blocks 43,44. Grid 72 is shown as further having an integrally-formed horizontal cylindrical portion 74 extending rightwardly from the inner margin of flange portion 73 in axially-spaced relation to cathode surface 70, and as having an integrally-formed rightwardly-convex hemi-spherical portion 75 arranged in spaced concentric relation to emitting surface 71.

An accelerator grid 76 surrounds the control grid. Grid 76 is also shown as being a cup-shaped member provided with an annular vertical flange 78 about its leftward open mouth. Flange 78 is adapted to be secured to the right vertical face of right block 44 by suitable means (not shown). Grid 76 also includes an integral substantially-cylindrical portion 79 extending axially rightwardly from the inner margin of flange 78 in spaced relation to control grid portion 74, and an integral rightwardly-convex hemi-spherical portion 80 arranged in spaced concentric relation to control grid surface 75. In the illustrated form, emitting surface 71 is of radius $R_1$, control grid surface 75 is of radius $R_2$, and accelerator grid surface 80 is of radius $R_3$, where $R_3 > R_2 > R_1$ and $R_2 \approx (R_1+R_3)/2$.

A plurality of pairs of radially-aligned apertures, severally indicated at 81,82 are provided through the control and accelerator grids, respectively, at various locations about the hemi-spherical portions of the cathode and the two grids. Each pair of apertures functions to permit a conical beam of electrons to be emitted normally from the cathode emitting surface. These beams overlap one another at a distance from the gun to produce an electron cloud. In lamp 41, the shaping electrodes 29,30 are again provided to distribute and normalize the electron cloud as it moves rightwardly toward the meshes. Thus, as shown in FIG. 6, the electron density immediately before reaching the field-separating mesh has a substantially-constant density (i.e., does not vary in magnitude by more than about 15–20%) across the projected area of the phosphor coating.

Third Form (FIGS. 7–9)

Referring now to FIG. 7, a third form of the improved lamp, generally indicated at 83, is again shown as including an evacuated tube 21 provided with a leftward neck portion 22, an intermediate funnel-shaped portion 23, and a rightward vertical face plate 24. A phosphor coating 25 is again provided on the inside surface of the face plate, and an LCD 26 is provided adjacent the outside surface of the face plate so that indicia thereon will be back-lighted by the improved lamp. Tube 21 is also shown as including elemental electron gun 42, as before.

This form differs from the first and second embodiments in that a secondary emission coating 84 is provided on the inside surface of funnel portion 23, in lieu of shaping electrodes 29,30. Thus, electrons issuing from gun 42 at a large angle $\theta$ will impinge coating 84, thereby exciting it to produce electrons which are directed toward the field-separating mesh 39 and secondary emission mesh 40.

To the extent that the electron cloud between coating 84 and mesh 40 is not of uniform electron density, the secondary emission coating on mesh 40 may be reciprocally non-uniform, as shown in FIG. 8. Thus, for example, if the density of the electron cloud decreases with the radial distance R from axis x—x, the efficiency or density of the secondary emission coating on mesh 40 may reciprocally increase with such radial distance, so that the electron cloud leaving the secondary emission mesh will be widely distributed and of substantially-constant electron density across the entire projected area of phosphor coating 25, as shown in FIG. 9. Alternatively, if the electron density of the cloud approaching mesh 40 has some other non-uniform distribution pattern, the thickness or density of the secondary emission coating on mesh 40 may be varied in some other reciprocally complimentary manner so that the cloud impinging upon coating 25 will be of substantially-constant electron density, all with the object of causing coating to produce light of substantially-constant intensity through the face plate to back-light the LCD.

Fourth Form (FIGS. 10–11)

The three forms of the improved lamp heretofore described have the capability of uniformly illuminating the face plate, regardless of whether an LCD is positioned in front of it or not. The various forms of the invention can be used for purposes other than back-lighting an LCD.

For example, as shown in FIG. 10, four or more of the improved panel lamps may be arranged in a rectangular array or matrix generally indicated at 85. This particular arrangement is illustrative only. Persons skilled in this art will readily appreciate that the number of columns and rows, as well as the face plate areas of the individual lamps, may be readily changed or modified to suit the particular end use. In any event, as shown in FIG. 11, the enclosures forming each individual lamp may be configured so as to share common intermediate walls, such as indicated at 86. However, the field-separating and secondary emission meshes 39,40, respectively may span all of the individual lamps in the particular array. Thus, in the embodiment illustrated in FIGS. 10–11, there are four individual lamps in the array, and these lamps may be controlled individually and independently of the others in the array. These various multi-panel arrays may be further arranged in a multi-lamp matrix, such as a stadium scoreboard (not shown) or the like,

Modifications

The present invention contemplates that many changes and modifications may be made. As previously noted, the face plate may be round, square, rectangular, or some other arcuate or polygonal shape. While it is preferably flat, in order to back-light a flat screen display, the face plate need not necessarily be so. Indeed, the face plate may be concave or convex, as desired, with an appropriate adjustment in the shaping means. The phosphor coating may have a substantially-constant efficiency, or a variable efficiency related inversely to the density of the electrons exciting the same, again with the desired object of producing light of substantially-uniform intensity across the entire area of the face plate. In the preferred embodiment, the intensity of such light transmitted through the face plate will not vary by more than about 15–20%. Moreover, the improved lamp may have an intensity on the order of about 10,000 ft-L at the outer surface of the face plate.

The electron gun may be either of the space charge effect-type, the elemental-type, the field effect transistor-type, or may possibly be of some other type. The function of the shaping electrodes and/or the secondary emission coating on the inside of the tube funnel portion, is to normalize the direction of the electron cloud within the tube, so that the electrons will be of substantially-constant density and will impinge upon the phosphor coating in a substantially-perpendicular manner. The secondary emission grid is desired, since it affords the capability of increasing the electron density immediately before the phosphor coating. However, if this feature is not desired, the secondary emission grid may be omitted altogether.

The invention is not limited to use in back-lighting displays. If desired, a number of such improved panels could be arranged in a matrix, and operated either independently or in conjunction with one another, either with or without a crystalline display superimposed thereon. For example, a matrix of such panels could be used in a stadium scoreboard or other display, in high-definition television (HDTV), or in a myriad of other possible applications.

Therefore, the invention broadly provides an improved cathode-luminescent panel lamp, which broadly includes an evacuated tube having a phosphor coating arranged on the inside of a face plate, an electron gun arranged within the tube in spaced relation to the coating, and shaping means arranged within the tube between the gun and the coating for normalizing the electron cloud and for causing light emitted by the coating through the face plate to be of substantially-constant intensity. The shaping means may be in the form of shaping electrodes, an emission coating, or a variable-density secondary emission coating on a mesh that is complimentary to the approaching electron cloud.

In use, the apparatus performs the improved method of creating a substantially-uniform illumination of a panel area, which method broadly includes the steps of: providing an evacuated tube having a face plate through which light is to pass; providing a phosphor coating on the inside surface of the face plate; providing an electron gun within the tube in spaced relation to the phosphor coating; causing the gun to emit a diverging beam of electrons toward the coating to form an electron cloud within the tube; and selectively shaping the beam such that the electron cloud impinging on the coating will have a substantially-constant electron density across the entire area of the coating; thereby to cause the coating to emit light of substantially-constant intensity through the face plate.

Therefore, while several presently-preferred forms of the improved cathode-luminescent panel lamp have been shown and described, and several modifications and changes thereof discussed, persons skilled in this art will readily appreciate that various additional changes and modifications may be made without departing from the spirit of the invention, as defined and differentiated by the following claims.

We claim:

1. A cathode-luminescent panel lamp, comprising:

an evacuated tube having an optical axis, having a face plate and having a phosphor coating arranged on the inside surface of said face plate, said phosphor coating functioning as an anode and being operatively arranged to convert electrons impinging thereon into light passing through said face plate;

a single electron gun arranged within said tube in spaced relation to said phosphor coating, said gun being operatively arranged to selectively emit at least one divergent beam of electrons toward said phosphor coating to form an electron cloud; and shaping means operatively arranged within said tube between said gun and phosphor coating for controlling the density of electrons striking said phosphor coating as a function of their angle from said optical axis and for distributing and normalizing the electrons in said cloud with respect to said face place and for causing the intensity of light emitted by said phosphor coating through said face plate to be substantially constant across the area of said face plate.

2. A cathode-luminescent panel lamp as set forth in claim 1 wherein said tube has a neck portion and has a funnel portion arranged between said neck portion and said face plate, and wherein said electron gun is arranged in said neck portion.

3. A cathode-luminescent panel lamp as set forth in claim 2 wherein said gun is a space charge effect electron gun.

4. A cathode-luminescent panel lamp as set forth in claim 1 wherein said shaping means includes a plurality of shaping electrodes arranged between said gun and face plate and operatively arranged to cause the cloud of electrons impinging upon said phosphor coating to be substantially constant over the area of said coating.

5. A cathode-luminescent panel lamp as set forth in claim 4 wherein said shaping electrodes are arranged on the inside surface of said tube.

6. A cathode-luminescent panel lamp as set forth in claim 5 and further comprising a field-separating mesh positioned between said shaping electrodes and said phosphor coating for separating the potential of said shaping electrodes from the potential of said anode.

7. A cathode-luminescent panel lamp as set forth in claim 6 wherein the cloud of electrons at said field-separating mesh is distributed substantially uniformly across the area of said mesh.

8. A cathode-luminescent panel lamp as set forth in claim 7 and further comprising a secondary emission mesh operatively arranged between said field-separating mesh and said coating for increasing the density of electrons in said cloud.

9. A cathode-luminescent panel lamp as set forth in claim 8 wherein said secondary emission mesh increases the electron density of said cloud.

10. A cathode-luminescent panel lamp as set forth in claim 9 wherein said coating has a substantially-constant efficiency.

11. A cathode-luminescent panel lamp as set forth in claim 1 wherein the density of electrons impinging upon said coating is not uniform across the area of said coating, and said coating has a variable efficiency such that the light emitted by said coating and passing through said face plate is substantially constant.

12. A cathode-luminescent panel lamp as set forth in claim 2 wherein said gun is an elemental electron gun.

13. A cathode-luminescent panel lamp as set forth in claim 12 wherein said gun has a cathode provided with a convex emitting surface and at least two grids aligned in spaced relation to said emitting surface, and wherein said grids are provided with a plurality of aligned apertures such that electrons will issue from said emitting surface through said cooperative aligned apertures as a conical electron beam.

14. A cathode-luminescent panel lamp as set forth in claim 8 wherein said secondary mesh is provided with an emission coating, and wherein the density of said secondary emission mesh coating is not uniform across the face of said mesh.

15. A cathode-luminescent panel lamp as set forth in claim 14 wherein the density of said secondary emission mesh coating varies inversely with the election density of the cloud approaching said secondary mesh so that the cloud impinging said phosphor coating will have a substantially-constant electron density across the area of said phosphor coating.

16. A cathode-luminescent panel lamp as set forth in claim 1 wherein a plurality of said tubes are arranged in an array to form a matrix.

17. A cathode-luminescent panel lamp as set forth in claim 16 wherein said tubes share common walls.

18. The method of creating a substantially-uniform illumination of an area, comprising the steps of:

providing an evacuated tube having and optical axis and having a face plate through which light is to pass;

providing a phosphor coating on the inside surface of said face plate;

providing an electron gun within said tube in spaced relation to said coating;

causing said gun to emit at least one diverging beam of electrons toward said coating to form an electron cloud; and shaping said electron cloud by controlling the density of electrons striking said phosphor coating as a function of their angle from the optical axis such that the electrons impinging upon said coating will have a substantially-uniform density across the area of said phosphor coating;

thereby to cause said phosphor coating to emit light of substantially-constant intensity through said face plate.

19. The method set forth in claim 18 and further comprising the additional step of: magnifying the density of the electron cloud emitted by said gun.

* * * * *